US008215270B2

(12) United States Patent
McKaig et al.

(10) Patent No.: US 8,215,270 B2
(45) Date of Patent: Jul. 10, 2012

(54) RECIPROCATING COMBUSTION ENGINE

(75) Inventors: Ray McKaig, Vancouver, WA (US); Brian Donovan, Vancouver, WA (US)

(73) Assignee: McVan Aerospace, LLC, Vancouver, WA (US)

( * ) Notice: Subject to any disclaimer, the term of this patent is extended or adjusted under 35 U.S.C. 154(b) by 729 days.

(21) Appl. No.: 12/319,900

(22) Filed: Jan. 12, 2009

(65) Prior Publication Data

US 2009/0250020 A1 Oct. 8, 2009

Related U.S. Application Data

(60) Provisional application No. 61/010,785, filed on Jan. 11, 2008.

(51) Int. Cl.
*F02B 75/18* (2006.01)

(52) U.S. Cl. ..... 123/56.2; 123/56.1

(58) Field of Classification Search ..... 123/56.2, 123/559.1, 54.1, 56.1, 190.1, 190.3, 190.4, 123/190.5, 190.6, 45 R, 50 R, 51 R, 43 AA, 123/43 C, 43 B
See application file for complete search history.

(56) References Cited

U.S. PATENT DOCUMENTS

| | | | | |
|---|---|---|---|---|
| 815,911 | A | | 3/1906 | Eddy |
| 1,177,609 | A | | 4/1916 | Edwards |
| 1,619,237 | A | | 3/1927 | Braff |
| 2,243,818 | A | | 5/1941 | Herrmann |
| 2,243,821 | A | | 5/1941 | Herrmann |
| 2,269,106 | A | | 1/1942 | Hoffman |
| 2,783,751 | A | | 3/1957 | Karlan |
| 3,745,981 | A | | 7/1973 | Warner |
| 3,924,578 | A | * | 12/1975 | Howard ..... 123/228 |
| 3,986,436 | A | | 10/1976 | Kaufman et al. |
| 4,030,471 | A | | 6/1977 | Ginkel |
| RE30,565 | E | | 4/1981 | Kristiansen |
| 4,287,858 | A | | 9/1981 | Anzalone |
| 4,341,730 | A | | 7/1982 | Maier |
| 4,366,784 | A | | 1/1983 | Paul |
| 4,370,959 | A | * | 2/1983 | McNair, Jr. ..... 123/295 |
| 4,413,474 | A | | 11/1983 | Moscrip |
| 4,434,757 | A | | 3/1984 | Walker |
| 4,476,821 | A | | 10/1984 | Robinson et al. |
| 4,510,894 | A | | 4/1985 | Williams |

(Continued)

FOREIGN PATENT DOCUMENTS

FR 857 052 8/1940

(Continued)

OTHER PUBLICATIONS

WO 8703644.*

(Continued)

*Primary Examiner* — Noah Kamen
*Assistant Examiner* — Long T Tran
(74) *Attorney, Agent, or Firm* — John Bruckner PC

(57) ABSTRACT

Methods and apparatus are described for a reciprocating combustion engine. A method includes operating a dual-piston engine including introducing a gas into a pair of combustion chambers; introducing a fuel into the pair of combustion chambers; compressing the gas; combusting the gas and the fuel; and exhausting combusted gases. Each of the pistons drives a reciprocating crankshaft that protrudes through a cylinder wall and cooperatively rotate a pair of rotors by engaging substantially sinusoidal cam tracks on the rotors. An apparatus includes a cam driven, concentric drive rotary-valve dual-piston engine.

23 Claims, 13 Drawing Sheets

Cylinder / Pistons Assembly

U.S. PATENT DOCUMENTS 4,516,536 A * 5/1985 Williams ..... 123/39
4,520,765 A 6/1985 Gerace
4,526,141 A 7/1985 Catchpole
4,544,096 A 10/1985 Burnett
4,553,508 A 11/1985 Stinebaugh
4,561,252 A 12/1985 David
4,594,062 A * 6/1986 Sakamaki et al. ..... 418/173
4,635,590 A * 1/1987 Gerace ..... 123/27 R
4,653,438 A 3/1987 Russell
4,658,768 A 4/1987 Carson
4,819,594 A * 4/1989 Tsakiroglou ..... 123/201
4,846,051 A 7/1989 Wade et al.
4,928,658 A 5/1990 Ferrenberg et al.
4,996,953 A 3/1991 Buck
5,113,670 A 5/1992 McAuliffe et al.
5,140,953 A 8/1992 Fogelberg
5,161,378 A 11/1992 Murray
5,242,288 A 9/1993 Vincent
5,302,874 A 4/1994 Pinkerton
5,343,832 A 9/1994 Murray
5,345,905 A 9/1994 Edwards
5,351,657 A 10/1994 Buck
5,429,078 A 7/1995 Tanigawa et al.
5,456,219 A * 10/1995 Clarke ..... 123/42
5,498,083 A 3/1996 Brown
5,535,715 A 7/1996 Mouton
5,641,280 A 6/1997 Timuska
5,695,199 A 12/1997 Rao et al.
5,791,868 A 8/1998 Bosley et al.
5,794,583 A 8/1998 Ichieda
5,992,356 A 11/1999 Howell-Smith
6,058,894 A 5/2000 Kobayashi et al.
6,062,175 A 5/2000 Huang
6,096,143 A 8/2000 Ruckert et al.
6,119,649 A 9/2000 Raab
6,142,729 A 11/2000 Tran et al.
6,199,519 B1 3/2001 Van Blarigan
6,202,606 B1 3/2001 Anttila
6,220,208 B1 4/2001 van de Werve
6,293,242 B1 9/2001 Kutlucinar
6,305,334 B1 10/2001 Schuko
6,315,531 B1 11/2001 Schwarz
6,341,590 B1 1/2002 Barrera et al.
6,386,152 B1 5/2002 Lawes
6,401,671 B1 6/2002 Leathwaite
6,412,273 B1 7/2002 Rohs
6,457,443 B1 10/2002 Lillbacka
6,481,393 B1 11/2002 Drew
6,505,837 B1 1/2003 Heshmat
6,526,925 B1 3/2003 Green, Jr.
6,601,547 B2 8/2003 Al-Hawaj
6,601,548 B2 8/2003 Al-Hawaj
6,615,793 B1 9/2003 Usack
6,629,513 B1 10/2003 Goetzman
6,668,809 B2 12/2003 Lowi et al.
6,691,648 B2 2/2004 Beierle
6,779,494 B1 8/2004 Aswani
6,880,494 B2 4/2005 Hoose
6,881,027 B2 4/2005 Klaass et al.
6,895,906 B1 5/2005 Gahan
6,920,754 B2 7/2005 Arnold et al.
2002/0124816 A1 * 9/2002 Schmied ..... 123/42

FOREIGN PATENT DOCUMENTS

GB 2 301 625 12/1996
WO WO 87/03644 6/1987
WO WO 2007/036007 4/2007

OTHER PUBLICATIONS

Notification, International Search Report and the Written Opinion, PCT/US2009/00207, Jun. 25, 2009 (12 pages).

* cited by examiner

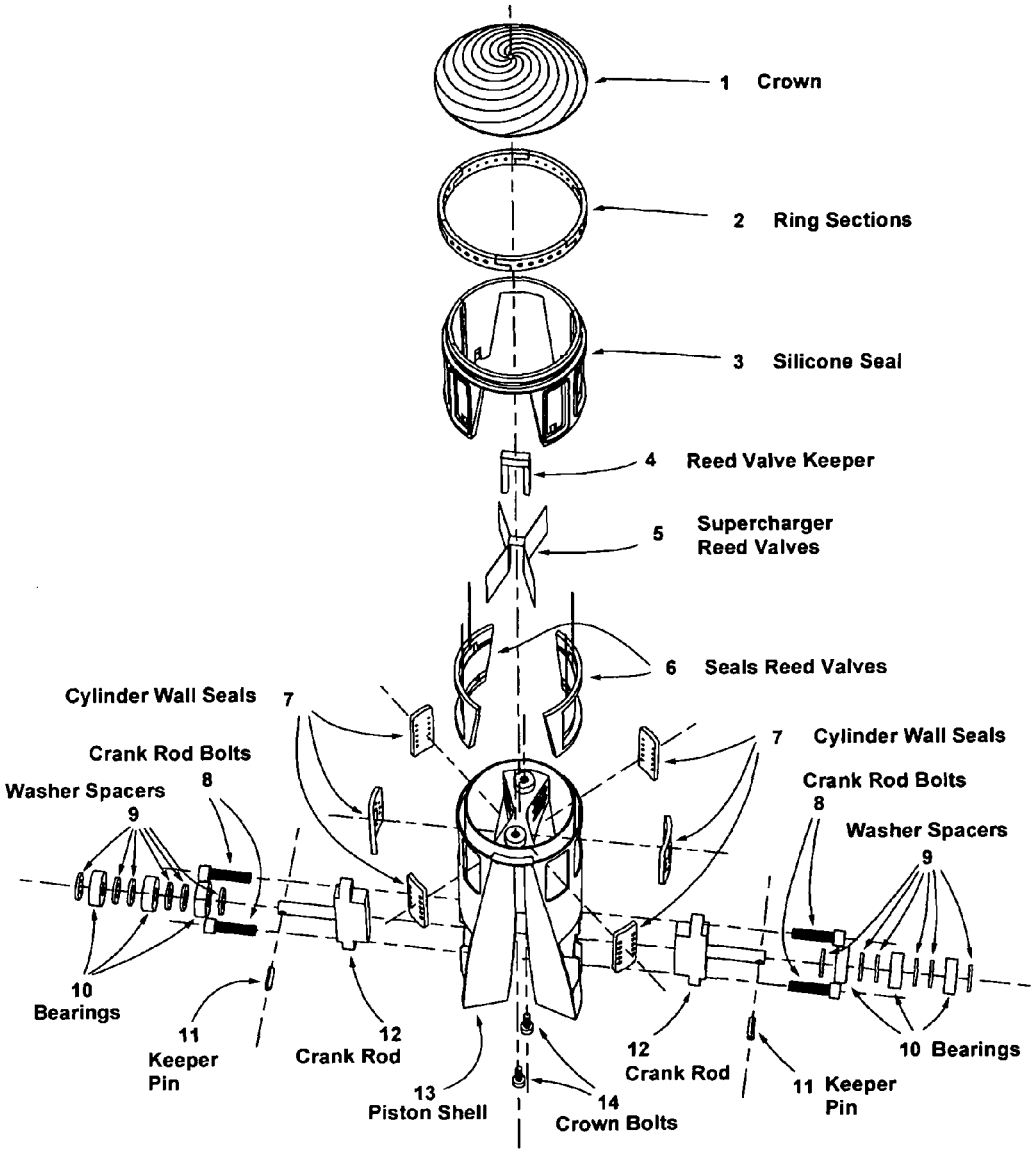
Figure 1 Piston Assembly

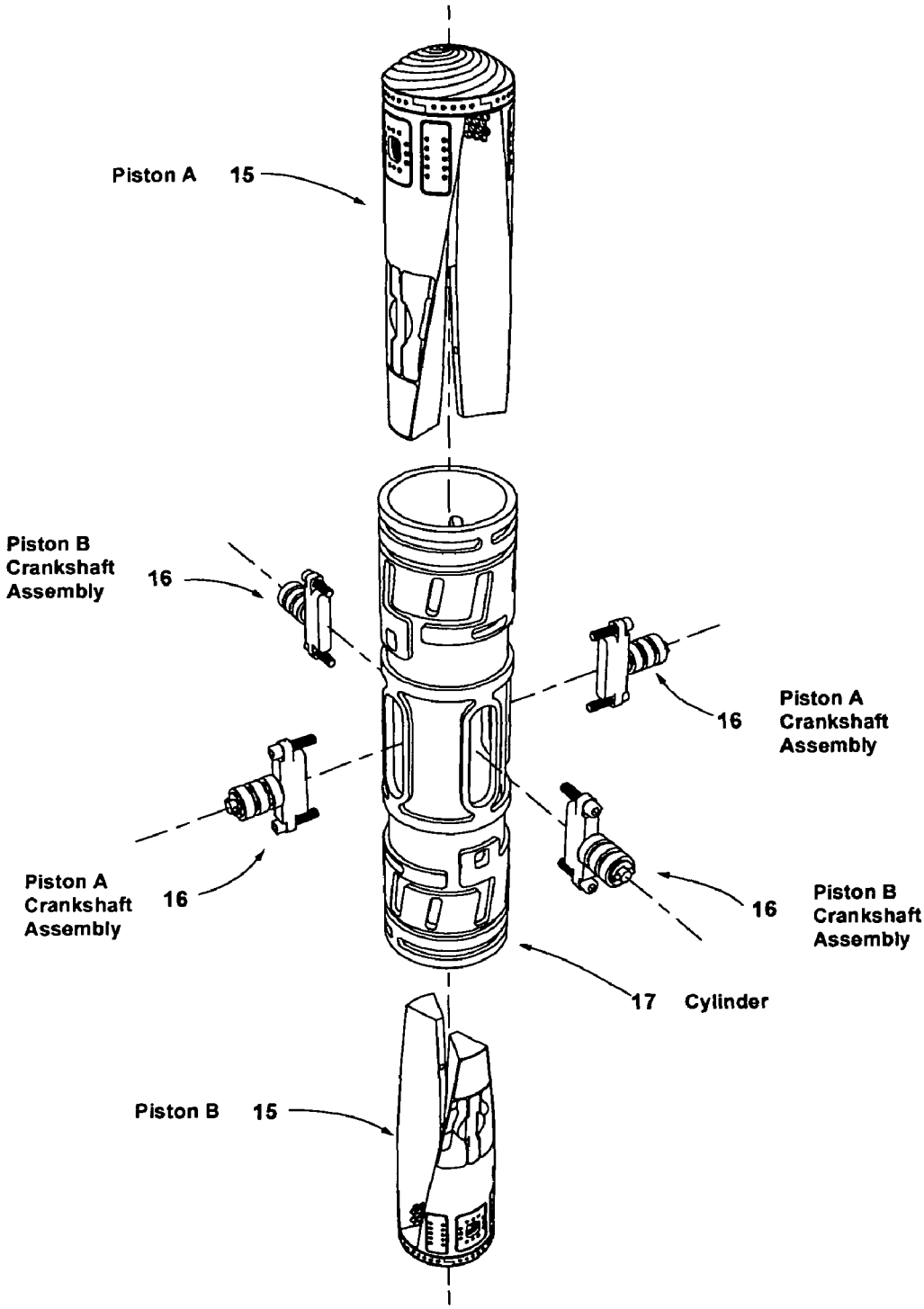
Figure 2 Cylinder / Pistons Assembly

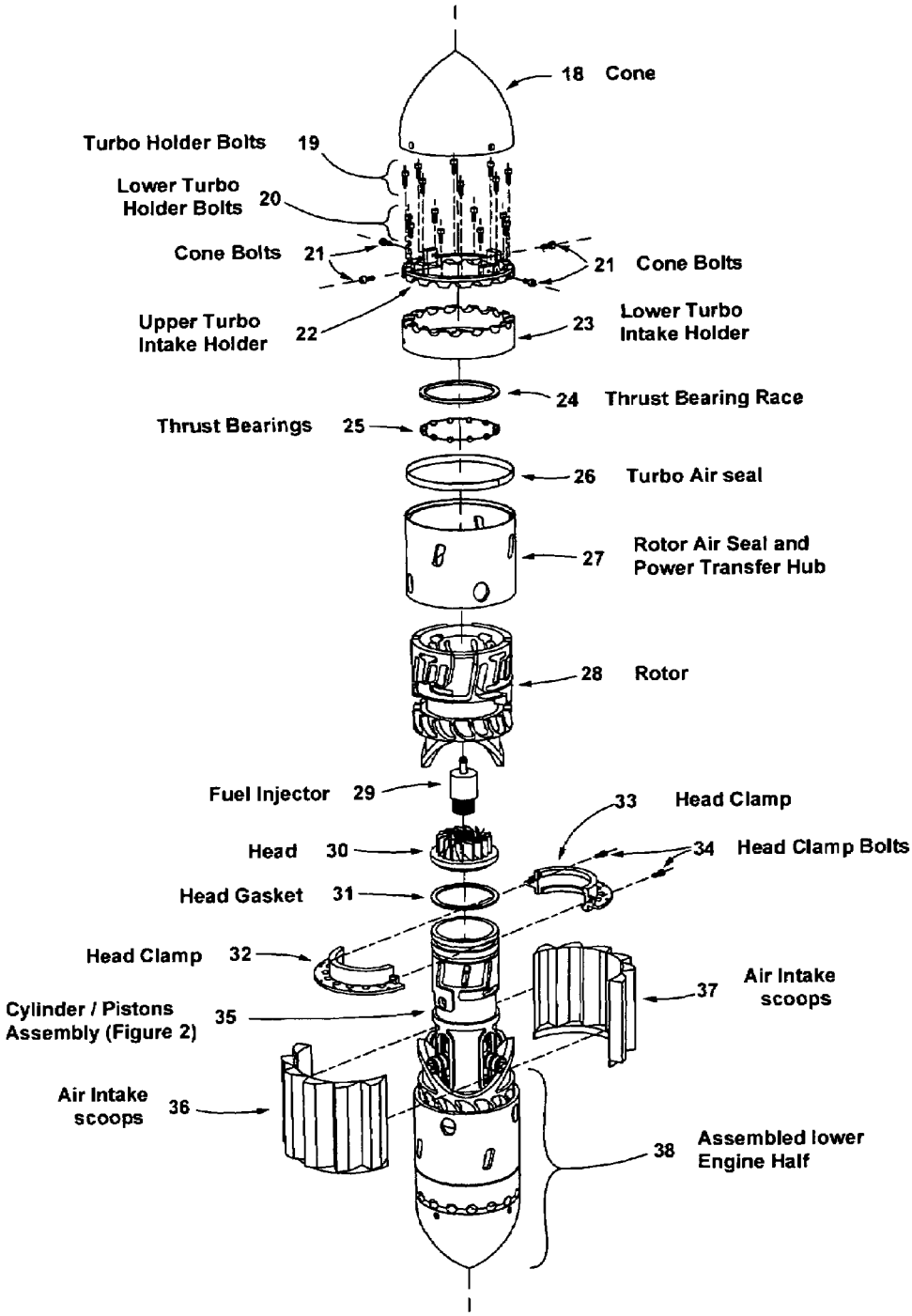
Figure 3 Engine Assembly

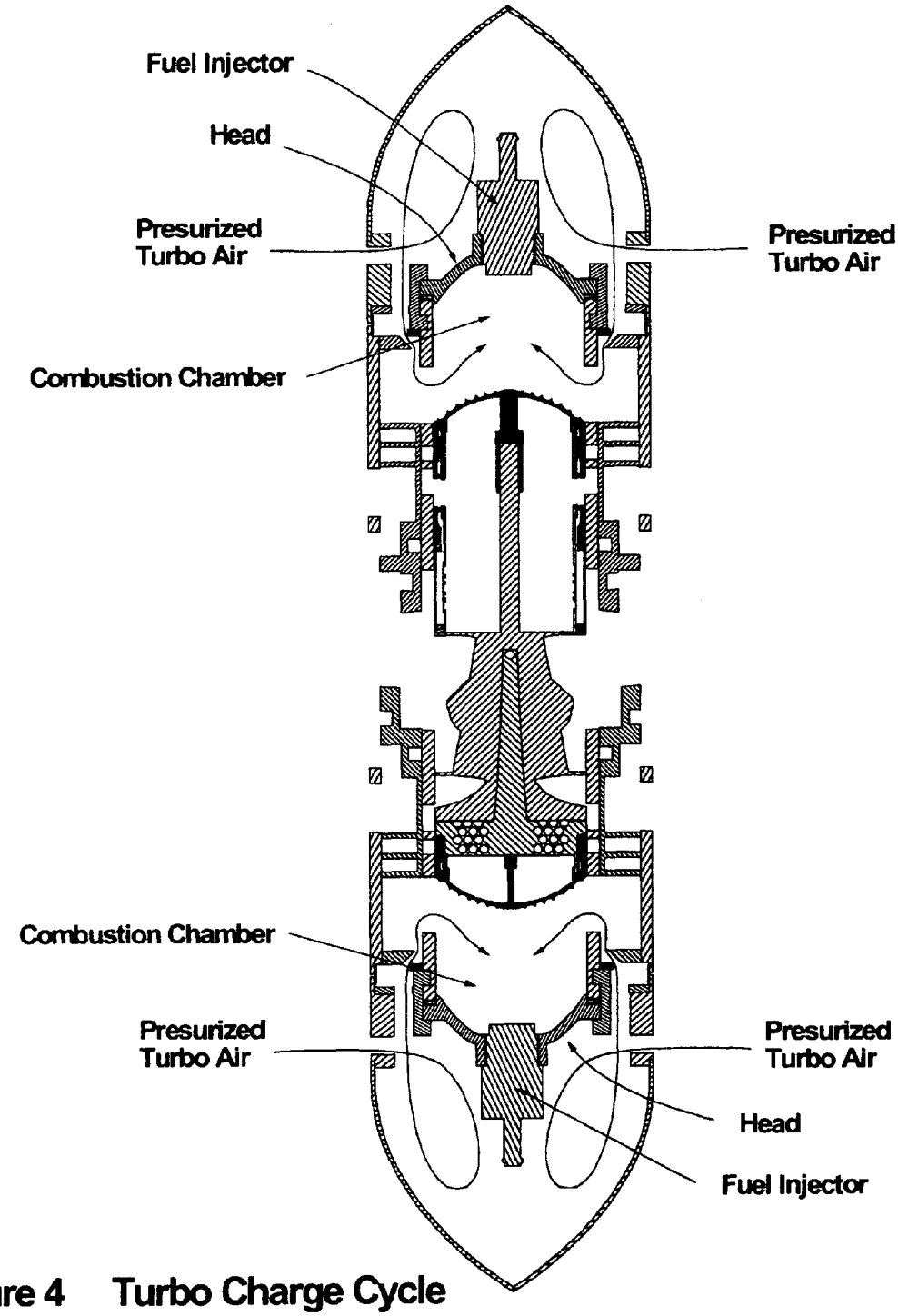
Figure 4 Turbo Charge Cycle

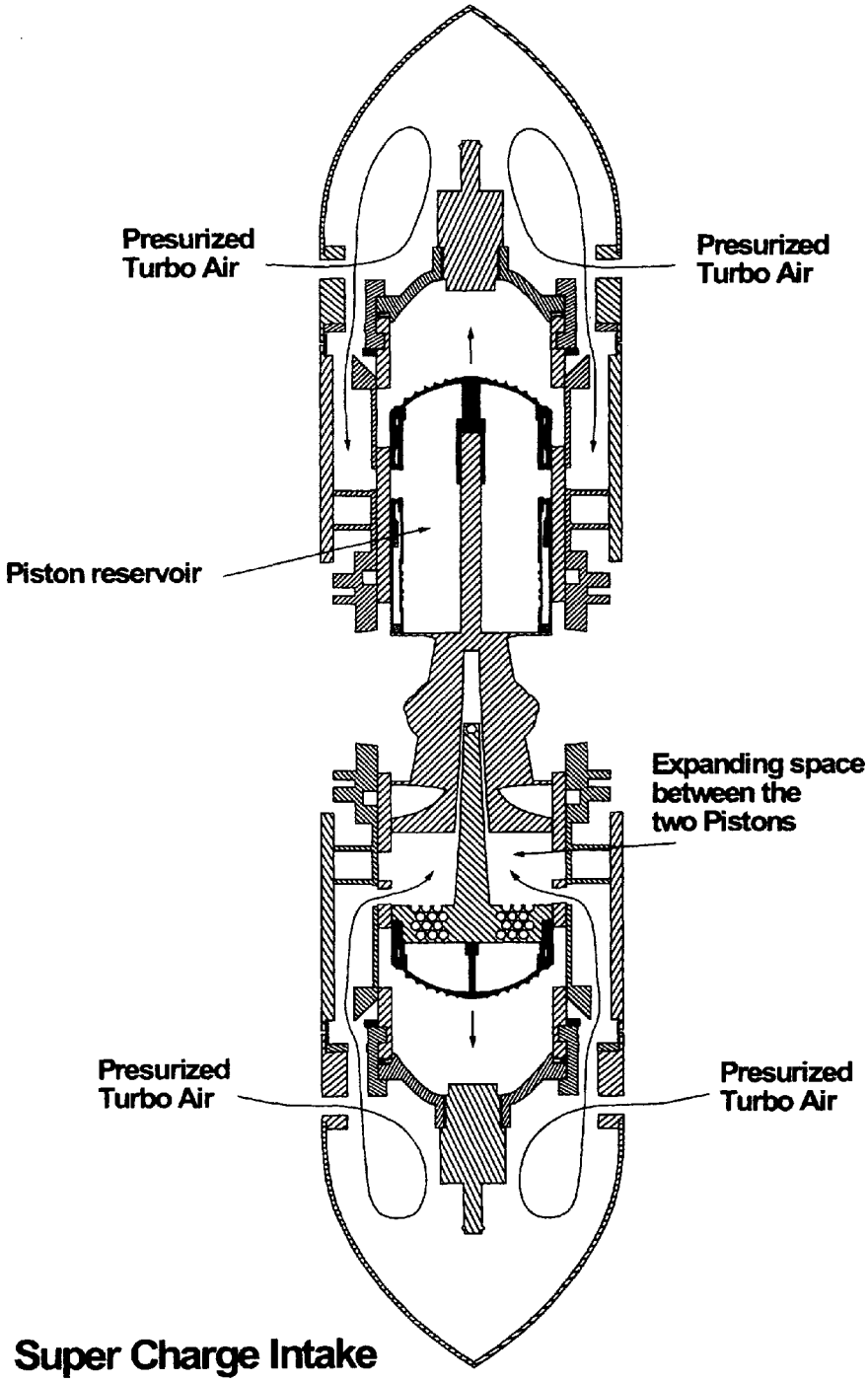
Figure 5 Super Charge Intake

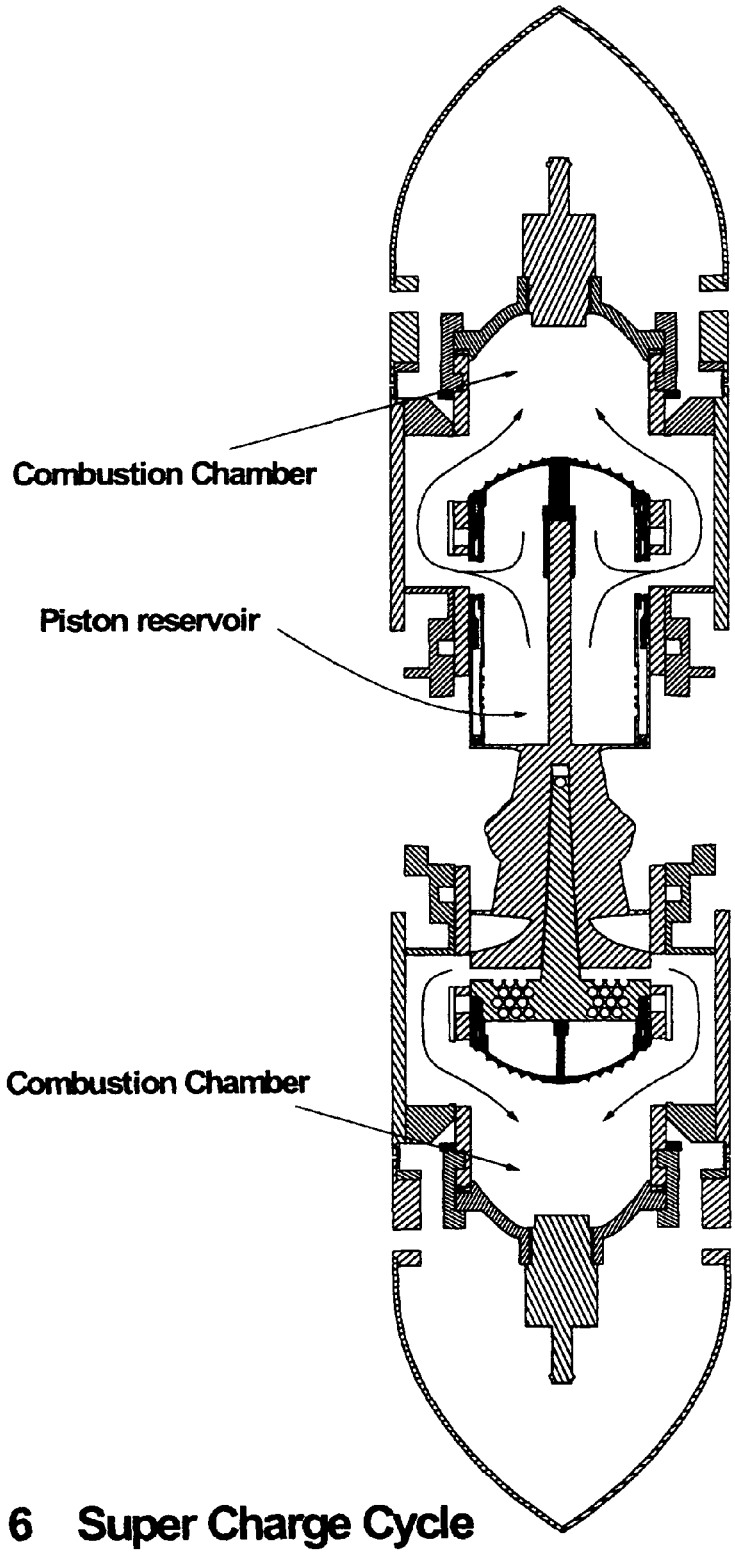
Figure 6 Super Charge Cycle

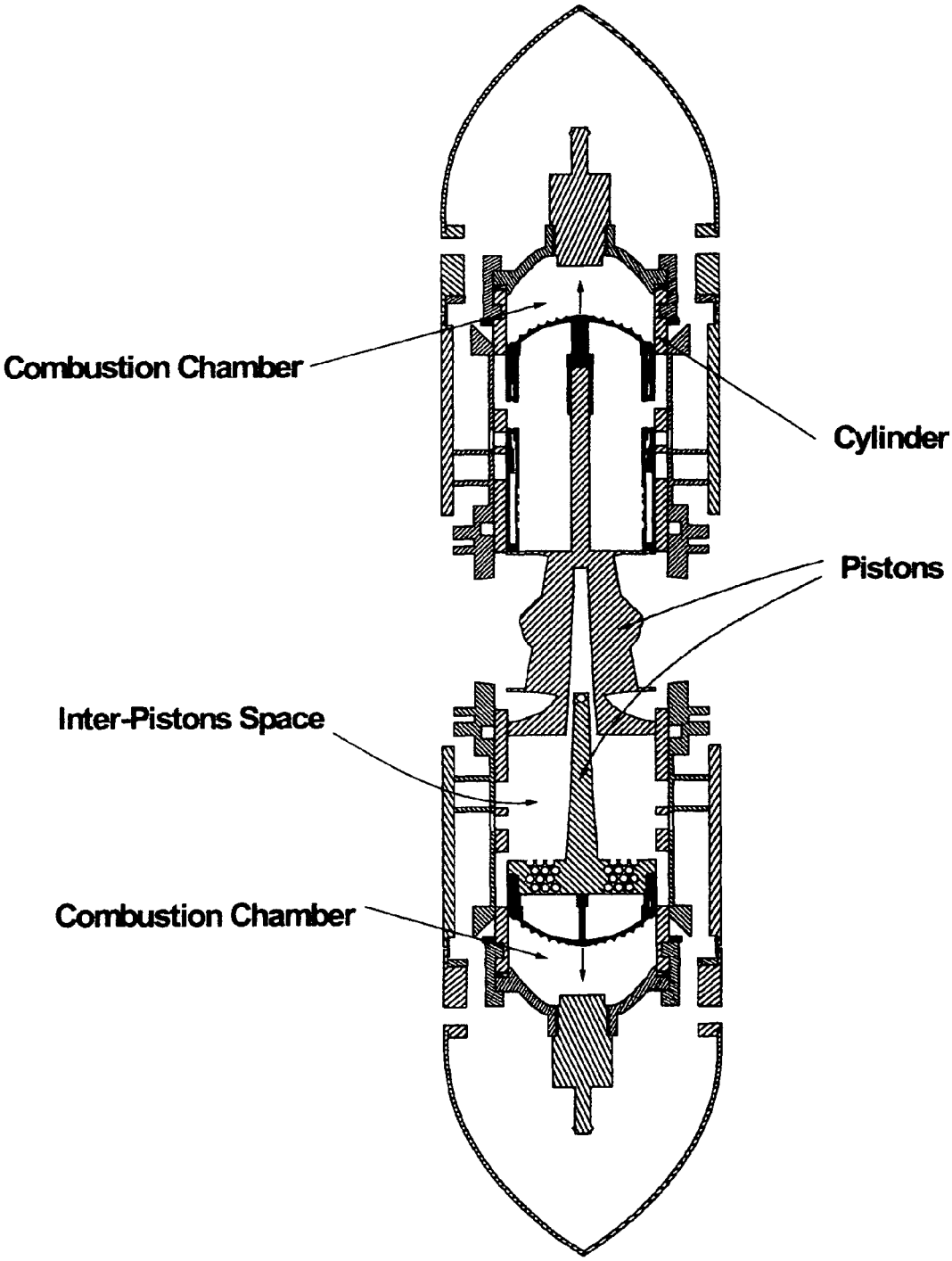
Figure 7 Compression Cycle

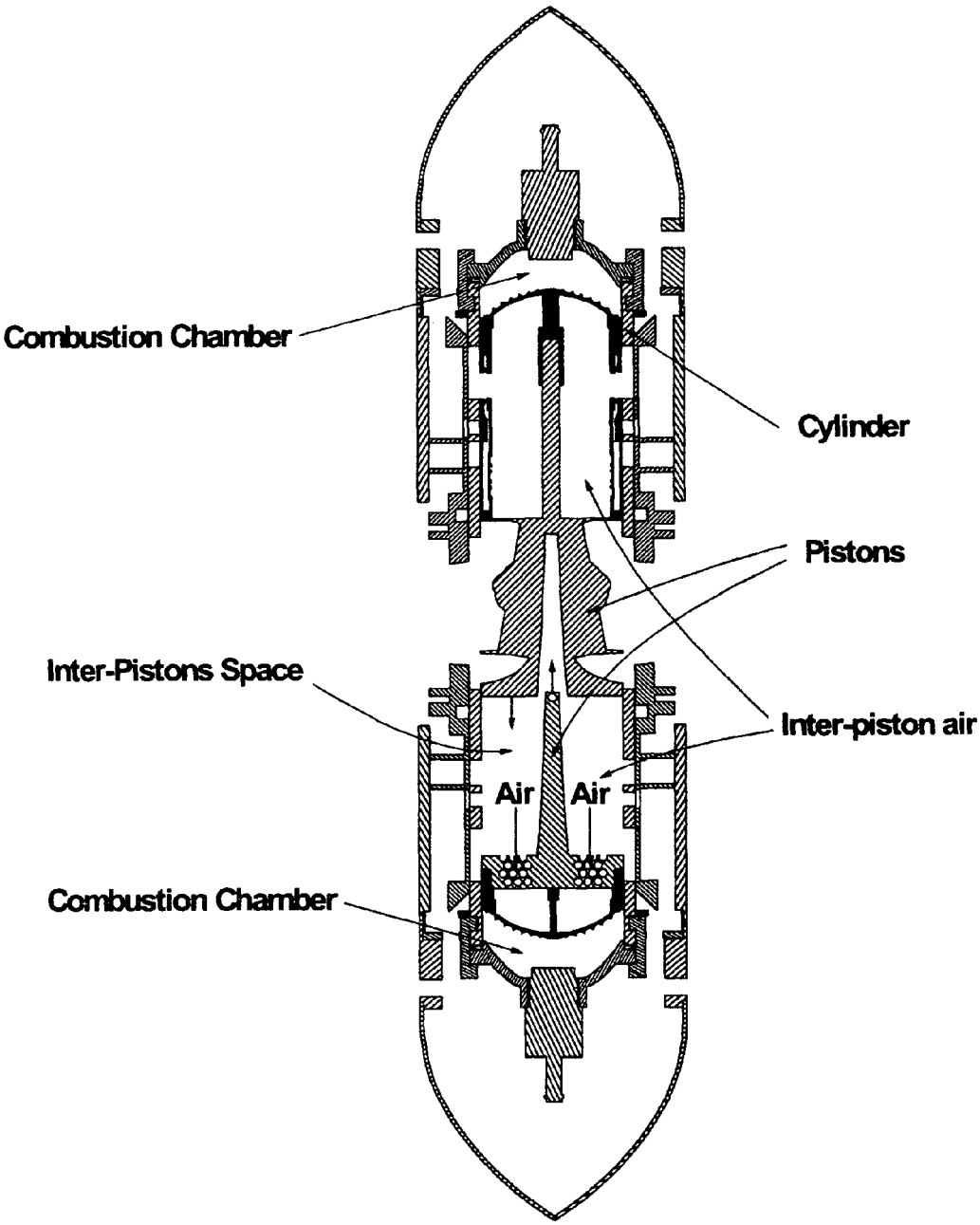
Figure 8 Combustion Cycle

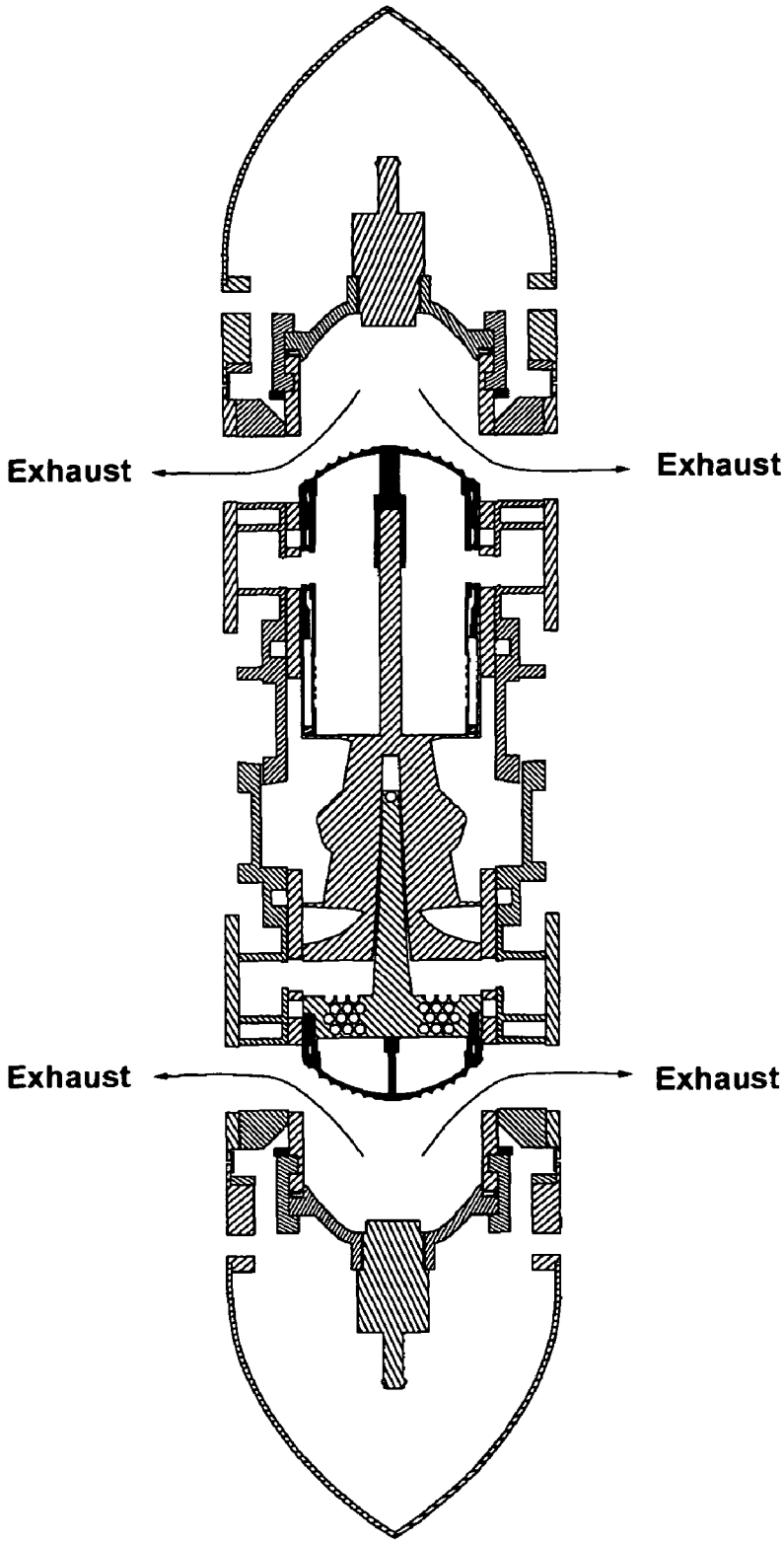
Figure 9 Exhaust Cycle

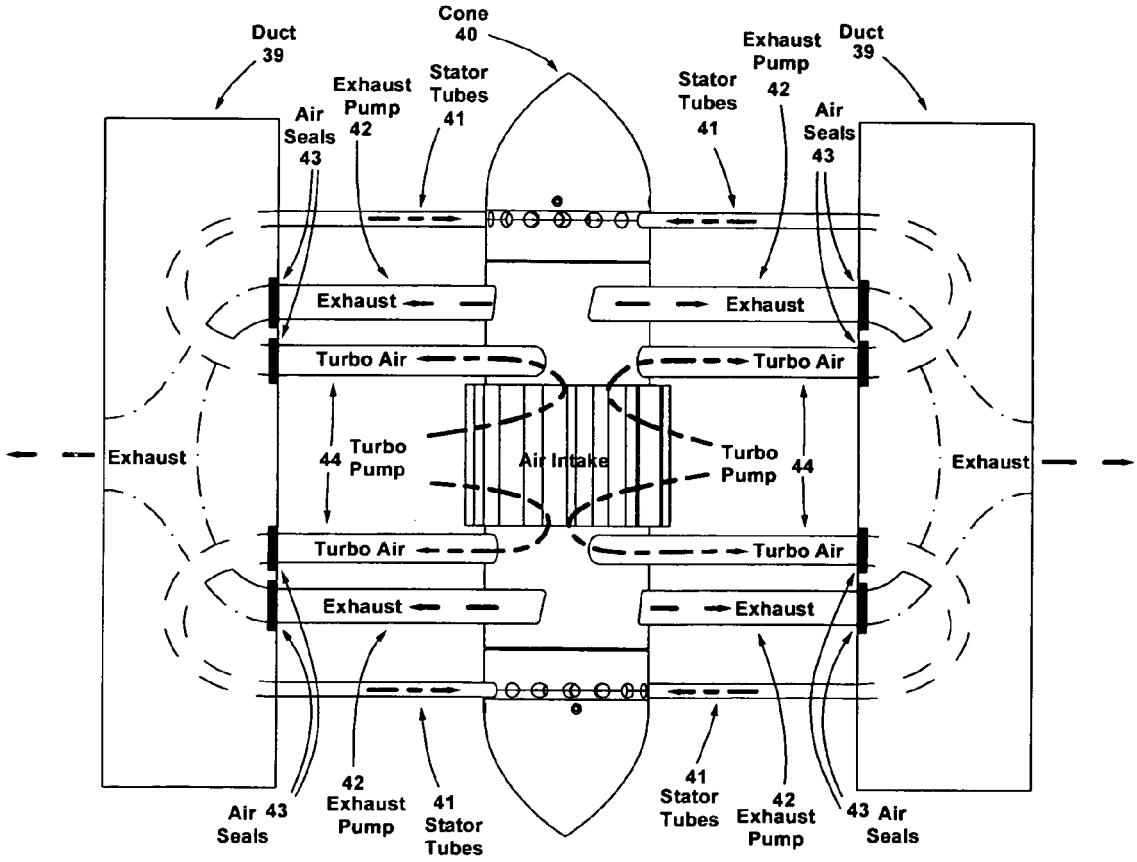
Figure 11 Preferred Embodiment Airflow

RECIPROCATING COMBUSTION ENGINE

CROSS-REFERENCE(S) TO RELATED APPLICATION(S)

This application claims a benefit of priority under 35 U.S.C. 119(e) from copending provisional patent application U.S. Ser. No. 61/010,785, filed Jan. 11, 2008, the entire contents of which are hereby expressly incorporated herein by reference for all purposes.

BACKGROUND INFORMATION

1. Field of the Invention

Embodiments of the invention relate generally to the field of reciprocating internal combustion engines. More particularly, an embodiment of the invention relates to a light weight, high power density, low vibration, cam (bearing) follower driven reciprocating internal combustion engine.

2. Discussion of the Related Art

Most engines are based upon early 1900 designs with few innovations. In general, engines require heavy crankshafts and counter-weights with considerable cooling and lubrication systems. Most designs move pistons in multiple directions thus increasing side friction and wear. Valve systems to control ports require significant energy to overcome friction and spring pressures. When additional functionality is required, more systems are added which further increases complexity, size, and weight.

Heretofore, the requirements referred to above have not been fully met. What is needed is a solution that, preferably simultaneously, solves all of these problems.

SUMMARY OF THE INVENTION

There is a need for the following embodiments of the invention. Of course, the invention is not limited to these embodiments.

According to an embodiment of the invention, a process comprises: operating a dual-piston engine including introducing a gas into a pair of combustion chambers; introducing a fuel into the pair of combustion chambers; compressing the gas; combusting the gas and the fuel; and exhausting combusted gases, wherein each of the pistons drives a reciprocating crankshaft that protrudes through a cylinder wall and cooperatively rotate a pair of rotors by engaging substantially sinusoidal cam tracks on the rotors. According to another embodiment of the invention, a machine comprises: An apparatus includes a cam driven, concentric drive rotary-valve dual-piston engine.

These, and other, embodiments of the invention will be better appreciated and understood when considered in conjunction with the following description and the accompanying drawings. It should be understood, however, that the following description, while indicating various embodiments of the invention and numerous specific details thereof, is given for the purpose of illustration and does not imply limitation. Many substitutions, modifications, additions and/or rearrangements may be made within the scope of an embodiment of the invention without departing from the spirit thereof, and embodiments of the invention include all such substitutions, modifications, additions and/or rearrangements.

BRIEF DESCRIPTION OF THE DRAWINGS

The drawings accompanying and forming part of this specification are included to depict certain embodiments of the invention. A clearer concept of embodiments of the invention, and of components combinable with embodiments of the invention, and operation of systems provided with embodiments of the invention, will be readily apparent by referring to the exemplary, and therefore nonlimiting, embodiments illustrated in the drawings (wherein identical reference numerals (if they occur in more than one view) designate the same elements). Embodiments of the invention may be better understood by reference to one or more of these drawings in combination with the following description presented herein. It should be noted that the features illustrated in the drawings are not necessarily drawn to scale.

FIG. 1 is an exploded perspective view of a piston assembly, representing an embodiment of the invention.

FIG. 2 is an exploded perspective view of a cylinder/pistons assembly, representing an embodiment of the invention.

FIG. 3 is an exploded perspective view of an engine assembly, representing an embodiment of the invention.

FIG. 4 is a cross sectional operational view of a turbo charge cycle, representing an embodiment of the invention.

FIG. 5 is a cross sectional operational view of a super charge intake, representing an embodiment of the invention.

FIG. 6 is a cross sectional operational view of a super charge cycle, representing an embodiment of the invention.

FIG. 7 is a cross sectional operational view of a compression cycle, representing an embodiment of the invention.

FIG. 8 is a cross sectional operational view of a combustion cycle, representing an embodiment of the invention.

FIG. 9 is a cross sectional operational view of an exhaust cycle, representing an embodiment of the invention.

FIG. 11 is a cross sectional operational view of an airflow, representing an embodiment of the invention.

DESCRIPTION OF PREFERRED EMBODIMENTS

Embodiments of the invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the embodiments of the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Overview of the Invention:

This invention is a small-sized and lightweight, air-cooled two-piston reciprocating internal-combustion engine. The invention has exceptional power-to-weight ratio, vibration-free and torque-free aspects. The engine operates in two-stroke mode with rotary-valve ports so that each piston cycle yields a power stroke with distinct individual gas-transfer phases for improved performance. With only four major moving components, the invention generates enhanced turbo-charged-air and supercharged-air pressures for high power capabilities, and has the ability to operate well at high altitudes. Due to the linear motion counter-opposing balanced pistons, engine vibration is kept at a minimum. Counter-rotating rotor assemblies minimize engine-twisting torque. The two engine rotors operate at a lower turning rate than the piston cycle rate yielding high engine horsepower for lower rotor speeds. High compression ratios allow the engine to combust a variety of fuels. Fuel efficiency is expected to be significantly high due to reduced friction, higher operating temperatures, and recycled engine heat.

The engine is well suited for aviation power with counter-rotating propellers, as well as general-purpose applications such as electrical generators for hybrid cars.

This invention's design goals were to overcome prior-art engine inefficiencies by using current state-of-the-art materials and technology. In addition, a major necessity for light aircraft use required increased engine power-to-weight ratios. In order to accomplish these goals, we designed multiple functions into the engine components to simplify engine complexity and to reduce the number of components. Utilizing every area of the engine for some functionality facilitated an overall small-sized package.

Figures 13A, 13B, 13C:
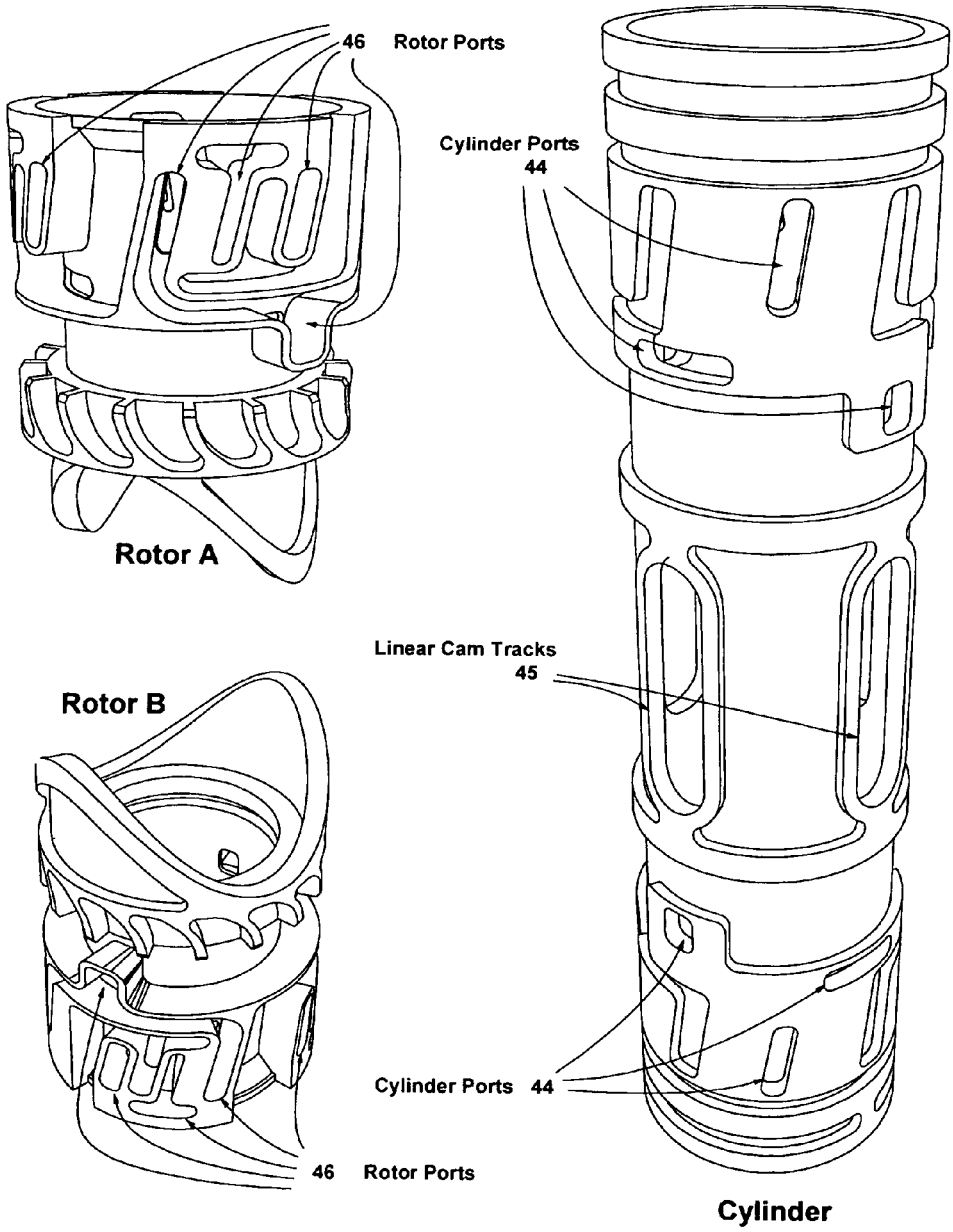
FIGS. 13A-13C are perspective views of a first rotor (13A), a second rotor (13B) and a cylinder (13C), representing an embodiment of the invention.

Structure of the Invention:

The core of the invention consists of a single cylinder with side ports (FIG. 13, Ref. 44), and enclosing two identical counter-opposing pistons facing opposite to each other (FIG. 12), and surrounded by two rotor assemblies that enclose the cylinder ends (FIG. 13). Two head assemblies close the two cylinder ends (FIG. 3, ref. 30).

The two identical pistons are designed to fit snugly together into a cylindrical union with little airspace between them when they are at their closest locations (FIG. 12). The pistons are rotated 90 degrees with respect to each other and interlock together, forming an air pump between the two pistons and the cylinder wall. During engine operation, air is drawn in between the two pistons and is passed through one-way reed valves within the pistons into compressed air storage areas (FIG. 1, Ref. 5), serving four purposes:

1. It cools the pistons internally by passing cooling gas over the internal piston surfaces.
2. It provides pressurized air for the supercharger function (exiting through two holes in the side of each piston).
3. It cushions the pistons during the down-stroke reducing bearing wear.
4. It provides pressure for the piston-cylinder seals (FIG. 1, Ref. 7) so that the seals float on a thin cushion of air rather than rub against the cylinder wall and wear.

Cylinder ports in conjunction with rotor ports (FIG. 13, Refs. 44 and 46) allow gasses to flow into and out of the engine in a variety of modes (FIGS. 4 through 9).

Each end of the cylinder has the following ports (FIG. 13, Ref. 44):

A. Four main ports 90 degrees apart for exhaust and combustion chamber air intake.
B. Two ports 180 degrees apart for turbo air to feed the space between the two pistons.
C. Two ports 180 degrees apart for supercharger outflow from the piston internal storage area.

Figures 10A, 10B, 10C, 10D, 10E, 10F, 10G, 10H:
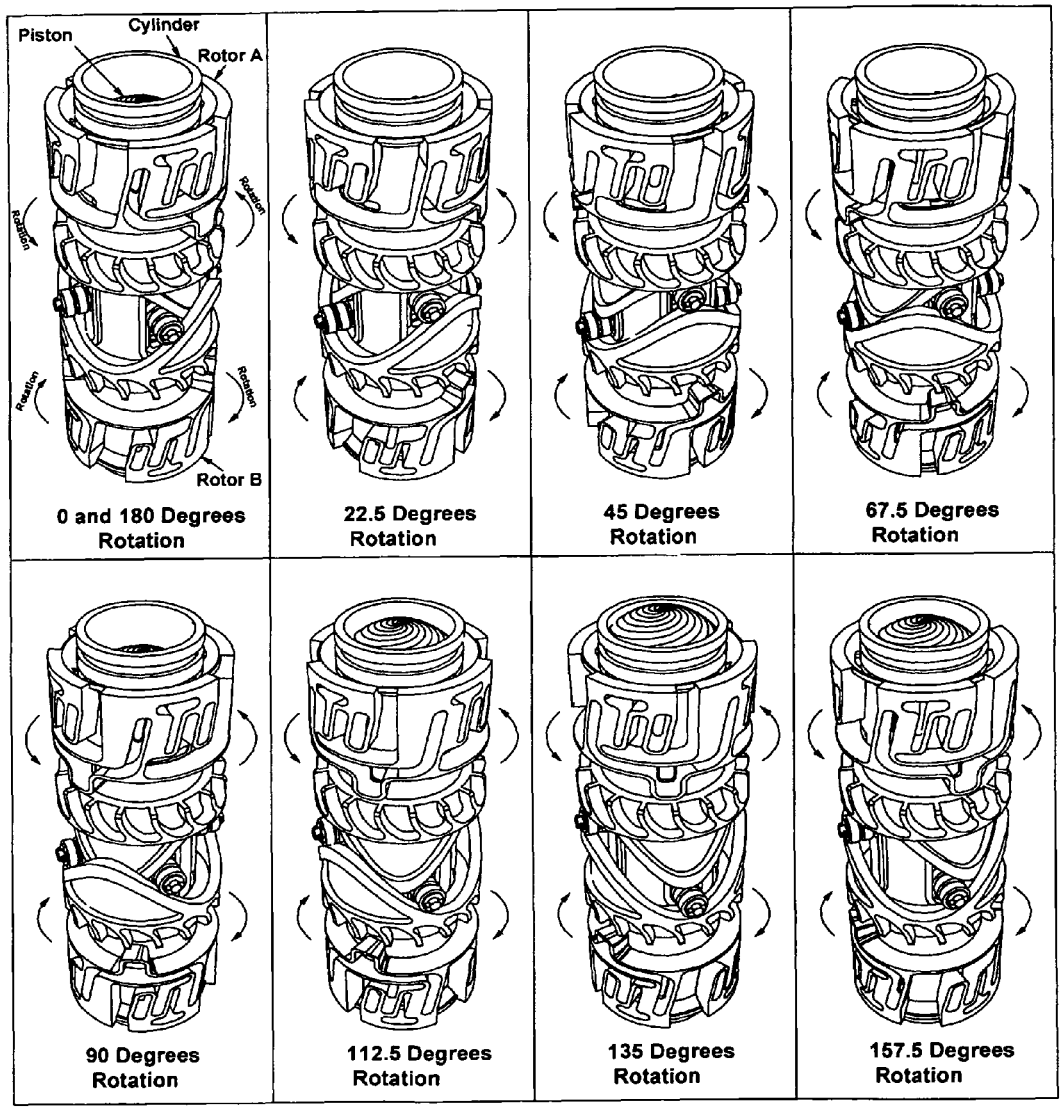
FIGS. 10A-10H are perspective views of eight rotation positions of the cylinders, representing an embodiment of the invention.
Figure 12A:
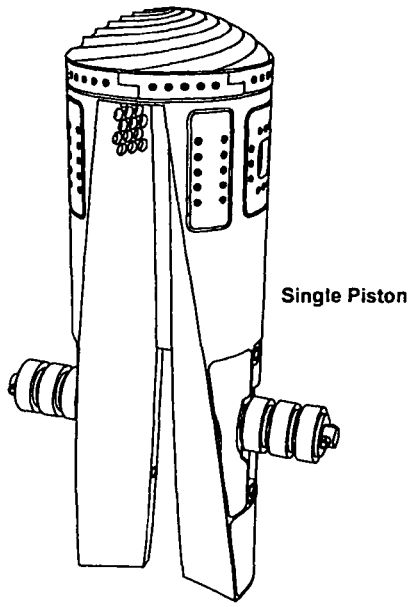
FIGS. 12A-12D are perspective views of a single piston (12A) and two piston interlocking at extended (12B), mid-extended (12C) and closed (12D) positions of the cylinders, representing an embodiment of the invention.
Figure 12B:
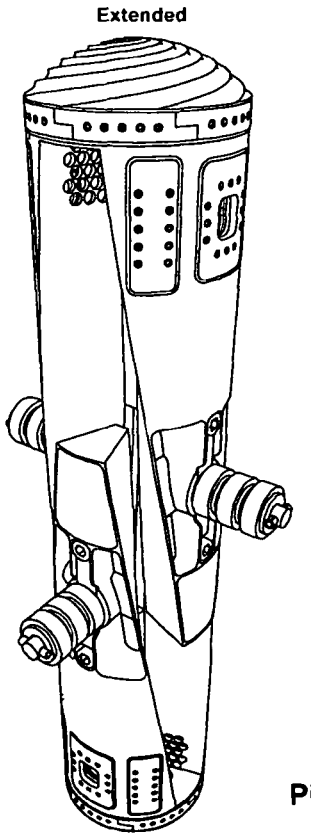
Figure 12C:
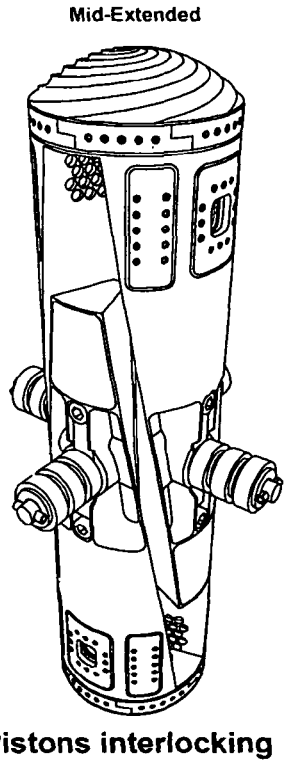
Figure 12D:
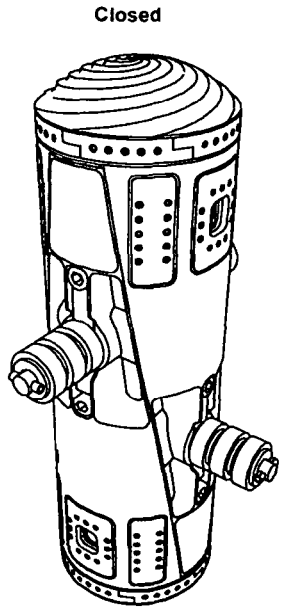

Each rotor has a sinusoidal or near-sinusoidal cam track facing toward the center of the cylinder (FIG. 13). Bearings protruding from the pistons on small crankshafts roll along the cam tracks, transferring rotational energy to the rotors from the pistons (FIG. 10). The rotors transfer power to the external world, as well as facilitating gas flows both into and out of the engine through port cutouts.

Each rotor can be made to turn in either direction by altering the engine port configuration during manufacture. The two head assemblies support injectors (FIG. 3, Refs. 29 and 30) for the introduction of fuel directly into the combustion chambers. Head clamps (FIG. 3, Ref. 32 and 33) fasten the head gaskets and heads (FIG. 3, Refs. 31 and 30) to the cylinder ends, hold the thrust bearings and bearing race in place (FIG. 2, Ref. 24 and 25), and provide a base to mount the stationary parts composing the engine ends (FIG. 2, Ref. 18 through 23). The engine ends are covered by cone enclosures to contain pressurized turbo-air that feeds the engine ports (FIG. 3, Ref. 18).

When the invention is operating, the pistons move toward and away from each other in opposing directions while the rotors both spin around the cylinder in opposite directions (FIG. 10). The rotors can be connected to a variety of devices such as propellers, belts or gears, thus transferring power from the engine to external devices. Airflow through the engine cools the parts, combusts the fuel, and finally passes out the exhaust ports (FIGS. 4 through 9).

This invention is small, lightweight, and is capable of operating at extended temperatures and accelerated rates with little engine wear.

FIGS. 1 through 3 depict exploded parts assembly for the core engine design.

Operation of the Invention:

During operation, the engine combustion cycle passes through several phases. Two pistons move linearly toward each other and away from each other in balanced synchronized harmony within the cylinder, while piston crankshaft bearings rolling along the linear cylinder cam tracks. Additional crankshaft bearings drive the pistons up and down by rolling on rotor cam tracks. The rotor cam track peaks and valleys are 180 degrees out of phase with each other (FIG. 13) so that the two piston motions move in opposite directions with respect to each other (FIG. 12). During the combustion cycle, the piston crankshaft bearings drive the rotor cam tracks, forcing the rotors to turn (FIG. 10). During the compression cycle, the turning rotor cam tracks drive the piston bearings, thus forcing the pistons apart.

On each side of the piston, the crankshaft's three bearings (FIG. 1, ref. 10) each roll along a different cam track. The two rotors form two sinusoidal cam tracks and the cylinder itself has a linear cam surface (FIG. 13, ref. 45) for the inner bearing to roll along. The linear cylinder cam tracks prevent the pistons from rotating, and allow the pistons to move along their linear travel paths within the cylinder while angular force is applied to the rotor cams. This bearing wedging action between the angled rotor cam tracks and the linear cylinder cam track walls (FIG. 10) cause angular force to be applied to the rotors, thus forcing them to turn.

Referring to FIG. 10, the basic engine structure is depicted in sequential operation during a single combustion cycle. Rotors turn in opposite directions while the cam surfaces drive the pistons in opposite linear directions. Due to the nature of the rotor cam track shapes, the rotors turn 180 degrees during one complete piston-combustion cycle for a 2:1 ratio without gears. For aircraft operation, 10,000 power strokes would yield 5,000 propeller rotations (each direction), resulting in considerably more horsepower than direct-drive propeller shaft systems with fewer power strokes.

For this example, assume that both pistons are nearly all the way down in their closest positions (interlocked) and the exhaust cycle (FIG. 9) has just evacuated the combustion chamber through open ports. Further, the pistons have just finished compressing turbo air between both pistons on their respective down strokes, and that compressed air now resides in both pistons storage chambers.

1. The rotors continue to rotate, closing the eight rotor exhaust ports and opening the eight rotor-turbo ports to match the combustion chamber port positions in the cylinder.
2. Pressurized turbo air flows into the evacuated combustion chambers (FIG. 4). Compressed turbo air flows over the heads and fuel injectors, cooling them. The turbo air continues through the engine ports and into the combustion chambers, yielding a substantial starting pressure before the compression stroke.
3. The eight rotor-turbo ports close as the rotors continue to turn, thus moving the cylinder and rotor ports out of alignment.
4. Four supercharger-loading ports located near the ends of the now-interlocked piston legs open to allow turbo air to flow into the soon-to-be expanding space between the two pistons (FIG. 5). Pressurized turbo air is introduced as depicted, but is shifted 90 degrees and cannot be fully shown for upper section. Turbo charged air flows between the two pistons durinq the compression upstroke and is later forced into the piston reservoirs when the pistons are forced together on the combustion downstroke. This process cools the piston internally and provides pressure for both the supercharge function and also for the air bearing seals on the pistons.
5. The four internal piston ports. and the four supercharger ports open, providing paths for supercharger pressurized air to flow out of the piston storage areas and into the combustion chambers (FIG. 6). Super-compressed turbo air flows out of the two pistons and into the combustion chamber already filled with compressed turbo air, thus providing a very high starting pressure prior to the upcoming compression stroke. This increases the combustion chamber pressure significantly prior to the compression cycle.
6. The four piston ports and the eight supercharger ports close as the rotors continue to rotate.
7. The pistons are now on their up-stroke and are in the process of separating apart. This occurs as the rotation of the rotor sinusoidal cam tracks force each piston toward the opposite ends of the cylinder. As the pistons separate, turbo air fills the expanding space between the two pistons, thus initiating the supercharger-loading phase (FIG. 7). During the compression stroke, the two pistons move apart. Turbo air continues to fill the space between the two pistons. Combustion chamber air at both ends of the cylinder becomes highly compressed. Gasses within the combustion chambers are compressed as the pistons move closer to the cylinder ends.
8. Once the pistons are fully extended apart (pistons at top-dead-center), the four supercharger-loading ports close, thus sealing the extended chamber between the two pistons.
9. As the pistons begin moving away from the cylinder ends due to the sinusoidal cam track motions, fuel is introduced into the combustion chambers from the injectors located in the heads. The highly compressed gasses in the combustion chamber have become quite hot due to the 3 stage compression cycles (turbo, super, and cylinder compression). Combustion begins as soon as the fuel comes in contact with the super-heated gasses, similar to standard diesel engine operation, and may be ignited with standard igniters to improve combustion characteristics.
10. During the combustion phase, the pistons are driven together by hot expanding-gas pressure in the combustion chambers, thus driving the rotor cams to turn and thus delivering power to the rotors. In addition, the turbo-air trapped between the two pistons is compressed as the pistons merge together, driving the compressed air through piston reed valves and into the piston storage areas, ready for the next supercharger cycle (FIG. 8). This pressurized air also flows through a second set of reed valves into smaller second piston chambers to provide pressure for the piston-to-cylinder seals. The compressed air filling the piston chambers also cools the piston each cycle from within. During the combustion cycle, the two pistons move toward each other, being driven together by expanding combustion gasses. Air between the two pistons is squeezed into the two piston reservoirs through one-way reed valves.
11. Once the pistons near their closest positions, the eight rotor exhaust valves open, allowing the hot combustion gasses to evacuate the combustion chambers (FIG. 9).
12. One combustion cycle is now complete, and the rotors have rotated one-half turn. This is due to the nature of the sinusoidal cam track, which has 2 complete sine peaks and valleys on opposite sides of the rotors, and match depth across the pistons so that the bearings on both sides of each piston roll equally on matched parts of the cam track. Note that it is possible to have more sinusoidal cam curves per rotor in equal numbers (for larger piston engines) that further reduce piston-to-rotor cycle turns to one quarter, one sixth, one eighth, etc. rotor rotations per piston cycle.

It should be noted that the design of the engine is such that most of the thermal loss through cooling and absorbed radiated heat is recycled back into the combustion chambers, eventually emerging out the exhaust. This should improve engine combustion efficiencies with less unburned fuel. Since the engine is expected to operate at higher temperatures than other engine designs, steel has been chosen as the preferred metal due to its high temperature capabilities and strength. The extended temperature range of the engine should also improve other engine efficiencies, such as reduced cooling requirements.

An embodiment of the invention can also be included in a kit-of-parts. The kit-of-parts can include some, or all, of the components that an embodiment of the invention includes. The kit-of-parts can be an in-the-field retrofit kit-of-parts to improve existing systems that are capable of incorporating an embodiment of the invention. The kit-of-parts can include software, firmware and/or hardware for carrying out an embodiment of the invention. The kit-of-parts can also contain instructions for practicing an embodiment of the invention. Unless otherwise specified, the components, software, firmware, hardware and/or instructions of the kit-of-parts can be the same as those used in an embodiment of the invention.

EXAMPLE

A specific embodiment of the invention will now be further described by the following, nonlimiting example which will serve to illustrate in some detail various features. The following example is included to facilitate an understanding of ways in which an embodiment of the invention may be practiced. It should be appreciated that the example which follows represents an embodiment discovered to function well in the practice of the invention, and thus can be considered to constitute preferred mode(s) for the practice of the embodiments of the invention. However, it should be appreciated that many changes can be made in the exemplary embodiment which is disclosed while still obtaining like or similar result without departing from the spirit and scope of an embodiment of the invention. Accordingly, the example should not be construed as limiting the scope of the invention.

The preferred embodiment of the invention includes centrifugal pumps attached to the rotors (FIG. 11). These pumps consist of tubes spinning around the engine, and are attached to rotor ports. Gas is flung outward toward the ends of the tubes when rotating, thus creating a void near the rotor hub and creating pressure at the outer tube ends. These tubes are terminated in a hollow duct with pressure seals to contain the pressurized gasses. For aircraft use, these centrifugal pump tubes are located within the propellers.

The centrifugal pumps serve several purposes:

1. The exhaust pumps provide a vacuum pressure to facilitate speedy removal of exhaust gasses from the combustion chambers. This results in more complete spent gas removal and more clean air replacement volume (without the need for resonant-tuned exhaust pipes to improve efficiency). Exhaust heat may be recovered within the duct for heating purposes.
2. The air intake pumps serve to provide turbo air pressure for the engine operation. The pressurized turbo air is routed back to the ends of the engine through stator tubes to cool the engine and provide engine operating air as described above in the 'Operation of the Invention' section.
3. A side benefit of the turbo pump provides warm pressurized air for a variety of useful functions such as a cabin pressure source and pressure-operated control motors.

The preferred embodiment of the invention operates in two-stroke mode using counter-rotating propellers contained in a ducted-fan configuration. Due to the small cross-section of the engine hub, little air resistance is encountered within the duct. The propellers terminate at the duct into a circular ring, with holes and jets to provide exiting-gas orifices for the centrifugal pumps. Air bearings between the duct and the circular ring serve to seal centrifugal pump gases and to provide low friction thrust-transfer pressure from the spinning propellers to the duct. The two propeller assembly circular rings provide mounting of small magnets for starter-motor and generator functions within the duct environment. This results in a high torque engine-starting function due to the leverage distance from the engine hub. When running, the magnets facilitate generated power for battery charging and general system operation. In addition, the magnets and motor functions may be used for stabilizing the propeller assemblies as may be needed during engine resonance phases, and during forced engine twisting such as caused by a turning vehicle.

Gas jets at the tips of the centrifugal pumps are aimed opposite from the direction of propeller rotation, thus providing some propeller acceleration in the case of exhaust gas pressures, and recovery of gas acceleration losses incurred during the pumping process. (Gas may be accelerated near the speed of sound during the pumping rotation.) Exhaust gasses are cooled and muffled by baffles, then finally ejected quietly at the rear of the duct. The duct should also provide propeller noise damping for quiet engine operation.

Additional and Unusual Invention Aspects:

1. Oil-Free Operation

In order to reduce weight and the requirement for messy oil systems, this invention uses air for its lubricant wherever possible. Main crankshaft piston bearings and thrust bearings utilize silicon-nitride ceramic bearings in lieu of steel bearings to provide better characteristics and longevity than standard bearings. Steel surfaces that contact the ceramic bearings are hardened in the preferred embodiment.

2. Piston-Cylinder Pressurized Air Seals

In order to provide oil-free piston sealing without appreciable wear, air is pumped through holes in the piston seals to provide a thin air cushion between the cylinder wall and the seals. This allows the seals to float on the air cushion without rubbing. This can only be accomplished in a system like this invention where the pistons move linearly within the cylinder without being forced from side-to-side, as in conventional engine crankshaft-piston motions.

3. Head Seals

This invention uses the high-pressure to its advantage, by using the pressure to increase seal functionality. This invention's head gaskets are flexible and have a basic 'C' shape. 'Arms' of the gasket face toward the pressure source and are forced apart by increasing pressure. This action spreads the 'arms' tighter to the surfaces that need sealing. The result is improved seal integrity with pressure increase, rather than weakening it as in other systems.

4. Rotor Track Twist

The rotor cam tracks twist in such a way as to present maximum surface contact with the piston crankshaft bearings in any rotated position. Wherever the cam track contacts a bearing, the contact cam line is always parallel to the bearing surface. This is very important during the combustion and compression cycles where significant forces are transferred between the rotor track and the piston. As the contact location moves off-center when the rotors are turned and the piston bearing moves along the cam track, the cam track's twisted surface counteracts the rotor's rotated curvature, thus insuring a maximum 'footprint' contact area between the two.

Expected Invention Efficiency:

Most turbo or supercharged engines only achieve 1.2 atmospheres. Since the amount of air in the combustion chamber is directly related to the amount of fuel that can be burned, this invention can achieve over 6 times the horsepower capability than other similar engine sizes. In addition and in consequence, much higher operating altitudes can be realized than other piston-driven engines.

Due to the high pressures in the combustion chamber, high operating temperatures and engine speed, it is estimated that a 500 cc engine configuration (3" pistons, 2.2 inch stroke) can generate better than 200 horsepower with a rotor speed of 6000 RPM, and with exceptional fuel efficiency. Using an internal duct diameter of 40 inches, 800 pounds of thrust can be realized. In this configuration, the entire engine hub section is less than 6 inches across with a length of 2 feet. The entire engine, duct, propellers, starter motor/generator, battery, and associated control sections should weigh in at less than 50 pounds with a physical size of 4 feet diameter by 2 feet deep duct. In addition, the invention should operate well at exceptionally high altitudes due to its turbo and supercharger functions. The invention should work reliably well with a wide variety of fuels due to the high cylinder pressures, and with an adequate direct fuel injection system.

Additional and Alternative Invention Embodiments

1. Multiple sinusoidal cam-track sections can be used with large pistons in even-increments. The result is higher power capability due to the larger pistons, and slower-turning rotors. For example, four sinusoidal cam-track sections provide a 4:1 gearing ratio of piston-to-rotor cycles, six sections would provide a 6:1 gearing ratio.

2. A single sine-shaped slotted track rotor between the pistons can replace the two separate rotor tracks for unidirectional rotor operation. The forces of the piston down-strokes balance in the single rotor assembly so that the rotor thrust bearings have virtually no load applied to them. However, engine torque due to the unidirectional rotor assembly must be counteracted with stronger motor mounts.
3. This engine can be configured as a 4-stroke engine by changing the rotor and cylinder porting.
4. Liquid cooling can be implemented within the cylinder walls and other engine parts.
5. In the preferred embodiment, pistons are gas cushioned during both piston directions, thus reducing mechanical wear. The supercharger mechanism acts as a damper and spring to the pistons around bottom-dead-center positions. This is a considerable improvement over standard engine operation, where bottom-dead-center piston forces must be counteracted entirely by mechanical means.
6. Hollow pistons for supercharging are not required, and may be done externally as in other engine configurations.
7. For non-aviation designs, the propeller and ducts can be reduced in size and serve to provide smaller cooling fan functionality.
8. Non-propeller tubes or pipes may also be used for centrifugal pumping actions, providing adequate cooling and operating gas transfer functions for engine operation.
9. External engine cooling is also an option.
10. The engine can also be configured as a gas or liquid pump with motors driving the rotors.
11. The engine can be configured as a gas or liquid motor (Pneumatic or hydraulic).
12. The volume between two counter-opposing pistons can be used as a gas or fluid pump.
13. A single piston may act a pump or fluid motor. Both sides of a single piston can be used as a double acting pump or fluid motor. These could act as vibrators for compacting, hammering and other oscillating applications.
14. A single piston version allows double acting operation (combustion chambers on both ends of piston firing alternately).
15. A double-acting mode can use the area between pistons in the two-piston version, or both ends of a single piston for combustion or pumping actions. In double-acting dual-piston version, every piston half-stroke is a power stroke, twice the power strokes than 2-stroke operation provides. This occurs when two pistons are driven together by the standard combustion-strokes, and the area between the two pistons is compressed for an alternate power-stroke once the pistons reach bottom-dead-center positions. The center combustion drives the pistons back apart thus initiating the standard compression strokes for the cylinder ends as in the 2-stroke model. It should be noted that the center volume displacement is equal to both piston end-volume displacements for equal center combustion stroke power.
16. Cam and rotor bearings can be of any application-compatible type. Journal, needle, hydrostatic, active fluid, and slide bearings are all possible replacements for the preferred ball bearings.
17. The ball bearings could be replaced with raw bearing balls in the cylinder linear track and possibly with the rotor sine tracks. This would allow for much thicker and stronger crankshafts.
18. Rotary valves are driven by or are a part of rotating cam.
19. The cam tracks do not need to be sinusoidal, but they should be symmetrical so that both pistons move in synchronous harmony.
20. Alternate materials do not change the fundamental patent. Possible materials include: steel, ceramics, graphite composites, titanium, and aluminum (where temperature permits).
21. Alternate piston-ring structures are possible, including ring-less. Because of the linear piston motion and piston forces, this engine is one of the few that can use ring-less and air-bearing type piston seals.
22. The use of graphite fiber reinforced graphite for pistons, cylinders, and optionally rotors allows for completely low-wear seal-less operation over wide temperature ranges because of the low temperature coefficient of the material and the lack of sidewall forces.
23. Blow by piston sealing and centering is another possibility.
24. The supercharger inter-piston area may be a different volume than the combustion chambers.
25. Standard fuel injectors in conjunction with standard 'hot-pot', diesel, or spark ignition systems are easily accommodated.
26. Multiple Huba-core engines can be mechanically geared/linked together by flipping ends on adjacent engines and gearing or friction-coupling the rotors directly together, even in 2 dimensions for a 'wall' of engines. In this configuration, individual engines can be removed and serviced without shutting the system down. Staggered timing of engine combustion cycles will allow very quiet, smooth, and vibration-free operation.
27. For generator operation, magnets can be located around the rotors, and stationary coils can be organized inside duct walls.
28. Multiple turbo charge stages for higher air pressures can be implemented.
29. Possible configuration; Ductless. No integrated turbo charging.
30. Propellers or spokes in duct act as centrifugal Archimedes compressors, emptying into the hollow duct wall.
31. Reinforcing continuous cylinder around propeller tips supports propeller or spoke bearings and helps seal hollow duct walls.
32. Propeller assemblies, stators, or both may support the engine hub.
33. High circumferential speeds are optimal for use of lubrication-free foil air bearings, both near the engine hub and at the propeller or spoke tips.
34. Duct returns compressed turbocharged air through stators to engine hub.
35. Single rotating element jet engine version is possible by replacing or bypassing the piston combustion chamber with a jet engine combustion chamber.
36. Compressor and exhaust acceleration energy recovered by expelling gas through hollow propeller or spoke tip jets in reverse direction to tip motion.
37. Tip jet empties inside duct walls or within propeller duct for muffling and gas control.
38. Can support single propeller or dual counter rotating propellers.

39. Pressurized air and vacuum easily available for internal and external use.
40. Hollow stators can carry air, fuel, electricity, and control and status signals to and from both ends of the invention's engine core.
41. Stators can act as air vanes with blades to control air vectors, both for thrust and for duct intake air.
42. Stators can act as turbocharged-air inter-coolers by passing heat to the air moving through the duct.
43. The duct can house batteries, stator air vane controls, control electronics, control motors, engine starter motor and generator, exhaust muffler, and air channels for pressurized airflow.
44. The duct is fastened to engine mounts. The engine is supported within the duct by mechanical stator tubes and spinning-rotor duct-interface-rings using air-bearing pressures.
45. In aircraft systems, the engine supports the propellers, and the engine crankshaft must handle full propeller energies. In this system, the propellers support the engine, allowing the propeller hubs to be much smaller and lighter. Most of the thrust energy is directly transferred to the duct by the propeller-tip air-bearing rings, and is not handled by the engine. This frees the engine to only require handling the rotational energy of the rotors.
46. Additional cam tracks on the rotors can drive devices such as fuel pumps, mechanical valve systems, engine position sensors, generators, and other devices.

DEFINITIONS

The term substantially is intended to mean largely but not necessarily wholly that which is specified. The term approximately is intended to mean at least close to a given value (e.g., within 10% of). The term generally is intended to mean at least approaching a given state. The term coupled is intended to mean connected, although not necessarily directly, and not necessarily mechanically. The term proximate, as used herein, is intended to mean close, near adjacent and/or coincident; and includes spatial situations where specified functions and/or results (if any) can be carried out and/or achieved. The term distal, as used herein, is intended to mean far, away, spaced apart from and/or non-coincident, and includes spatial situation where specified functions and/or results (if any) can be carried out and/or achieved. The term deploying is intended to mean designing, building, shipping, installing and/or operating.

The terms first or one, and the phrases at least a first or at least one, are intended to mean the singular or the plural unless it is clear from the intrinsic text of this document that it is meant otherwise. The terms second or another, and the phrases at least a second or at least another, are intended to mean the singular or the plural unless it is clear from the intrinsic text of this document that it is meant otherwise. Unless expressly stated to the contrary in the intrinsic text of this document, the term or is intended to mean an inclusive or and not an exclusive or. Specifically, a condition A or B is satisfied by any one of the following: A is true (or present) and B is false (or not present), A is false (or not present) and B is true (or present), and both A and B are true (or present). The terms a and/or an are employed for grammatical style and merely for convenience.

The term plurality is intended to mean two or more than two. The term any is intended to mean all applicable members of a set or at least a subset of all applicable members of the set. The phrase any integer derivable therein is intended to mean an integer between the corresponding numbers recited in the specification. The phrase any range derivable therein is intended to mean any range within such corresponding numbers. The term means, when followed by the term "for" is intended to mean hardware, firmware and/or software for achieving a result. The term step, when followed by the term "for" is intended to mean a (sub)method, (sub)process and/or (sub)routine for achieving the recited result.

The terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. The terms "consisting" (consists, consisted) and/or "composing" (composes, composed) are intended to mean closed language that does not leave the recited method, apparatus or composition to the inclusion of procedures, structure(s) and/or ingredient(s) other than those recited except for ancillaries, adjuncts and/or impurities ordinarily associated therewith. The recital of the term "essentially" along with the term "consisting" (consists, consisted) and/or "composing" (composes, composed), is intended to mean modified close language that leaves the recited method, apparatus and/or composition open only for the inclusion of unspecified procedure(s), structure(s) and/or ingredient(s) which do not materially affect the basic novel characteristics of the recited method, apparatus and/or composition.

Unless otherwise defined, all technical and scientific terms used herein have the same meaning as commonly understood by one of ordinary skill in the art to which this invention belongs. In case of conflict, the present specification, including definitions, will control.

CONCLUSION

The described embodiments and examples are illustrative only and not intended to be limiting. Although embodiments of the invention can be implemented separately, embodiments of the invention may be integrated into the system(s) with which they are associated. All the embodiments of the invention disclosed herein can be made and used without undue experimentation in light of the disclosure. Although the best mode of the invention contemplated by the inventor(s) is disclosed, embodiments of the invention are not limited thereto. Embodiments of the invention are not limited by theoretical statements (if any) recited herein. The individual steps of embodiments of the invention need not be performed in the disclosed manner, or combined in the disclosed sequences, but may be performed in any and all manner and/or combined in any and all sequences. The individual components of embodiments of the invention need not be formed in the disclosed shapes, or combined in the disclosed configurations, but could be provided in any and all shapes, and/or combined in any and all configurations. The individual components need not be fabricated from the disclosed materials, but could be fabricated from any and all suitable materials. Homologous replacements may be substituted for the substances described herein. Agents which are both chemically and physiologically related may be substituted for the agents described herein where the same or similar results would be achieved.

Various substitutions, modifications, additions and/or rearrangements of the features of embodiments of the invention may be made without deviating from the spirit and/or scope of the underlying inventive concept. All the disclosed elements and features of each disclosed embodiment can be combined with, or substituted for, the disclosed elements and features of every other disclosed embodiment except where such elements or features are mutually exclusive. The spirit and/or scope of the underlying inventive concept as defined by the appended claims and their equivalents cover all such substitutions, modifications, additions and/or rearrangements.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

What is claimed is:

1. A method, comprising operating a dual-piston engine including introducing a gas into a pair of combustion chambers; introducing a fuel into the pair of combustion chambers; compressing the gas; combusting the gas and the fuel; and exhausting combusted gases, wherein each of the pistons drives a reciprocating crankshaft that protrudes through a cylinder wall and cooperatively rotates one of a pair of rotors by cam follower driving a substantially sinusoidal cam tracks located on that one of the pair of rotors, wherein rotary valves are driven by rotation of the pair of rotors.

2. The method of claim 1, further comprising turbo charging the gas.

3. The method of claim 2, further comprising supercharging the gas.

4. The method of claim 3, further comprising evacuating the pair of combustion chambers to lower backpressure at the exhaust ports.

5. The method of claim 1, wherein the substantially sinusoidal cam tracks on the rotors provide bi-directional rotor operation.

6. An apparatus, comprising a dual-piston engine, wherein each of the pistons drives a reciprocating crankshaft that protrudes through a cylinder wall and cooperatively rotates one of a pair of rotors by cam follower driving a substantially sinusoidal cam track located on that one of the pair of rotors, wherein rotary valves are driven by rotation of the pair of rotors.

7. The apparatus of claim 6, wherein the substantially sinusoidal cam tracks on the rotors provide bi-directional rotor operation.

8. The apparatus of claim 6, further comprising air bearings and silicon-nitride ball bearings to achieve oil-free operation.

9. The apparatus of claim 6, further comprising high-capacity centrifugal turbocharger pumps that approximately triple atmospheric pressure prior to utilization within the engine.

10. The apparatus of claim 9, further comprising a high-capacity supercharger pump between the pistons that has a volume that is substantially the same as both piston displacement to approximately double the air volume in the combustion chambers.

11. The apparatus of claim 6, wherein pressurized air bearing surfaces for piston rings and seals reduce cylinder wear.

12. The apparatus of claim 6, wherein centrifugal exhaust pumps lower backpressure at the engine exhaust ports, facilitating enhanced evacuation of the combustion chamber and resulting in higher horsepower capabilities due to the increased fresh air volume that the combustion chambers can accommodate.

13. The apparatus of claim 6, wherein the rotary valves include quadruple engine ports spaced 90 degrees apart in each combustion chamber enhance gas insertion and exhaust extraction by providing shorter paths and multiple directions for gas flow.

14. The apparatus of claim 6, wherein three-phase gas exchange cycles provide for high initial combustion chamber pressures, including immediately following the exhaust phase, first turbocharger, then supercharger pressures enter the combustion chambers in two additional phases.

15. The apparatus of claim 6, wherein pressure-compensating self-sealing head gaskets substantially insure gas-tight sealing action at all operating pressures without the need for torque bolts.

16. The apparatus of claim 6, wherein the rotor cam tracks twist to present substantially maximum surface contact with the piston crankshaft bearings throughout their rotated position.

17. The apparatus of claim 6 wherein dual rotor cams turning in opposite directions provide bi-directional torque-free rotor operation without heavy gears or transmissions.

18. The apparatus of claim 6, where the cams turn at subsets of the combustion cycle frequency without gear transmissions due to the multiple sinusoidal natures of the rotor cam tracks achieving higher horsepower values through increased power strokes per rotor revolutions.

19. The apparatus of claim 6, wherein substantially balanced pistons moving in substantially opposite directions substantially remove engine vibrations without the need for heavy counterweights.

20. The apparatus of claim 6, wherein air chamber areas within each piston 1) remove excess piston heat due to combustion and 2) provide a) delayed supercharger pressure storage functionality and b) pressure for floating the piston-to-cylinder seals stored in separate chambers and fed by the supercharger pressures.

21. The apparatus of claim 6, wherein the engine is air cooled.

22. A vehicle, comprising the apparatus of claim 6.

23. An aircraft, comprising the apparatus of claim 6.

* * * * *

UNITED STATES PATENT AND TRADEMARK OFFICE

CERTIFICATE OF CORRECTION

PATENT NO. : 8,215,270 B2
APPLICATION NO. : 12/319900
DATED : July 10, 2012
INVENTOR(S) : Ray McKaig and Brian Donovan It is certified that error appears in the above-identified patent and that said Letters Patent is hereby corrected as shown below:

In claim 1, column 13, line 24, replace “tracks” with -- track --.

Signed and Sealed this
Sixteenth Day of October, 2012

David J. Kappos

David J. Kappos
*Director of the United States Patent and Trademark Office*